US006495846B1

(12) United States Patent
Vaughan

(10) Patent No.: US 6,495,846 B1
(45) Date of Patent: Dec. 17, 2002

(54) APPARATUS AND METHOD FOR NUCLEAR WASTE STORAGE

(76) Inventor: James A. Vaughan, P.O. Box 2719, Pahrump, NV (US) 89041

( * ) Notice: Subject to any disclaimer, the term of this patent is extended or adjusted under 35 U.S.C. 154(b) by 0 days.

(21) Appl. No.: 09/511,875

(22) Filed: Feb. 25, 2000

Related U.S. Application Data

(60) Provisional application No. 60/121,814, filed on Feb. 25, 1999.

(51) Int. Cl.[7] ..... G21F 5/00
(52) U.S. Cl. ..... 250/506.1
(58) Field of Search ..... 250/506.1, 507.1

(56) References Cited

U.S. PATENT DOCUMENTS 2,748,673 A * 6/1956 Winstead ..... 229/117.28
4,453,081 A * 6/1984 Christ et al. ..... 250/506.1
4,950,426 A 8/1990 Markowitz et al.
5,402,455 A * 3/1995 Angelo et al. ..... 250/515.1
5,431,295 A 7/1995 Meess
5,442,186 A * 8/1995 Walker et al. ..... 220/254.8
5,562,592 A * 10/1996 Curiel ..... 206/522
5,818,059 A * 10/1998 Coyne et al. ..... 250/507.1
5,894,134 A * 4/1999 Kissinger ..... 250/506.1

* cited by examiner

*Primary Examiner*—Jack Berman
*Assistant Examiner*—Johnnie L Smith
(74) *Attorney, Agent, or Firm*—Wallenstein & Wagner, Ltd.

(57) ABSTRACT

The present invention is a nuclear waste storage apparatus and a method of filling the storage apparatus while the storage apparatus remains substantially sealed. The innermost layer of the apparatus comprises a self-sealing bladder. An injection device pierces the bladder and fills it with radioactive waste in a liquid, slurry or paste form in a substantially sealed process. When the injector is removed, the self-sealing material of the inner bladder substantially closes the pierced portion of the bladder. The bladder is then coated with a protective coating, a radioactive barrier coating, and an outer impact resistant coating to complete the apparatus.

12 Claims, 1 Drawing Sheet

APPARATUS AND METHOD FOR NUCLEAR WASTE STORAGE

CROSS-REFERENCE TO RELATED APPLICATIONS

This application claims priority to Provisional Patent Application Ser. No. 60/121,814, filed Feb. 25, 1999.

TECHNICAL FIELD

This invention generally relates to a storage apparatus for receiving and storing nuclear waste for safe handling and transportation to a disposal site. More specifically, the present invention relates to a multi-layer nuclear waste storage container including a self-sealing layer of material that can be penetrated for safe and efficient filling of the container during the filling process.

BACKGROUND OF THE INVENTION

Prior art apparatus and systems for nuclear waste storage typically have a concrete construction. A typical nuclear waste storage container is formed as a pre-cast modular concrete container. Concrete has been found to be a durable material for storage containers containing certain levels of radiation and certain forms of radioactive waste. For further protection against leakage, concrete containers have been provided with various lining materials. For example, granular fill material or grout has been poured into concrete containers to secure waste packages in place and to provide an additional barrier to radiation leakage. This type of lining material has been found to be effective for low level and short-lived radioactive wastes. This type of lining is described in U.S. Pat. No. 4,950,426.

Depending on the half-life of the particular radioactive material being handled, radioactive waste can remain as a hazardous material for 200 years or more. Such instances require a liner that is sufficiently durable over a long period while providing a leak-tight barrier for the radioactive waste. These types of liners are typically installed within a pre-formed concrete container. An impermeable liner disposed within a pre-cast concrete container is described in U.S. Pat. No. 5,431,295. The liner is a one-piece plastic molded liner that is inserted into the concrete container mold before the concrete is poured. The liner has ribs that are embedded into the concrete.

The use of concrete as a material for a storage container has some disadvantages. While providing a durable construction, concrete is not highly elastic and may chip or be damaged when subject to high impact, especially during transportation. Furthermore, these concrete containers utilize storage lids that do not provide a closed environment during the container filling process. The container lid must be removed while the container is filled.

Thus, there is a need for a nuclear waste storage container construction that eliminates the use of concrete and that is capable of being filled in a substantially sealed configuration. Furthermore, there is a need for a nuclear waste storage container construction that utilizes an outer material that has sufficient elastic properties while maintaining durability.

SUMMARY OF THE INVENTION

The present invention is a nuclear waste storage apparatus and a method of filling the storage apparatus while the storage apparatus remains substantially sealed. The apparatus is a container that can take the form of several different shapes and its construction comprises several layers. The innermost layer of the container comprises a rubber or plastic material that is self-sealing. The inner layer acts as a bladder for the contents of the container. This bladder is covered by a second layer of protective coating material. A radiation barrier layer is disposed over the protective coating layer. An outer layer of an elastic impact resistant material is disposed over the radiation barrier layer to complete the container construction.

Prior to coating the inner bladder with the subsequent layers, the inner bladder is filled with radioactive waste material prepared in slurry form. An injection device pierces the bladder and fills it in a substantially sealed process. When the injector is removed, the self-sealing material of the inner bladder substantially closes the pierced portion of the bladder. The bladder is then coated with the protective coating, the radioactive barrier coating, and the outer impact resistant coating.

DETAILED DESCRIPTION OF THE PREFERRED EMBODIMENTS

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
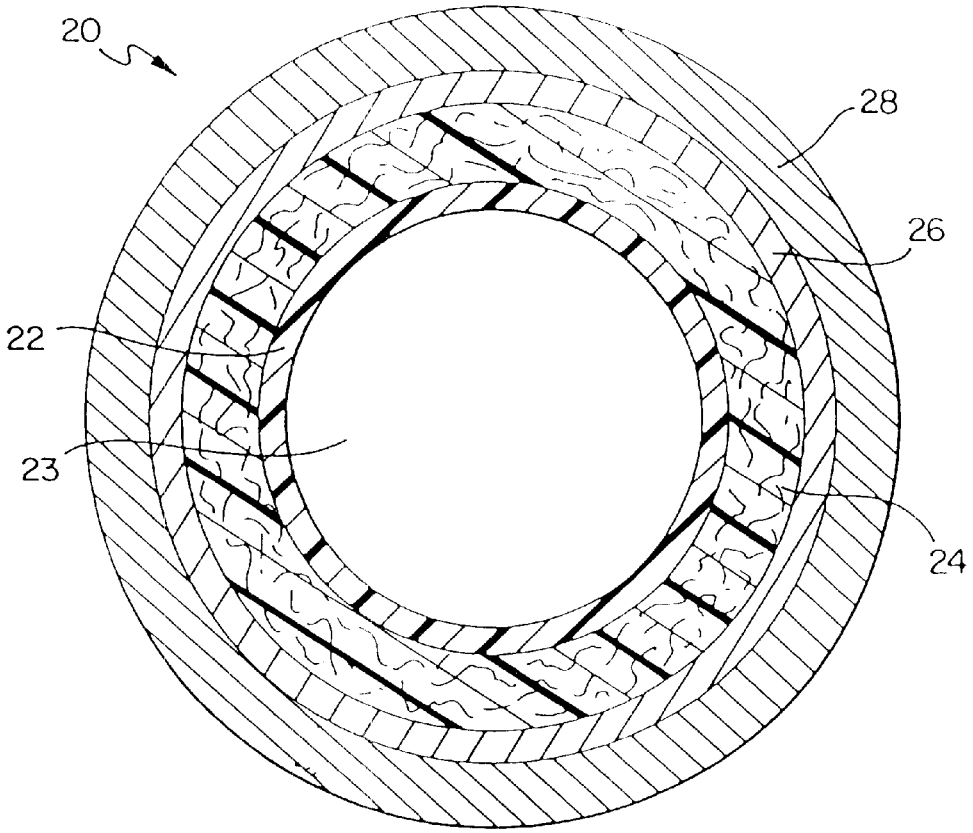
FIG. 1 is a cross-sectional view of an embodiment of a container apparatus of the present invention.
Figure 2:
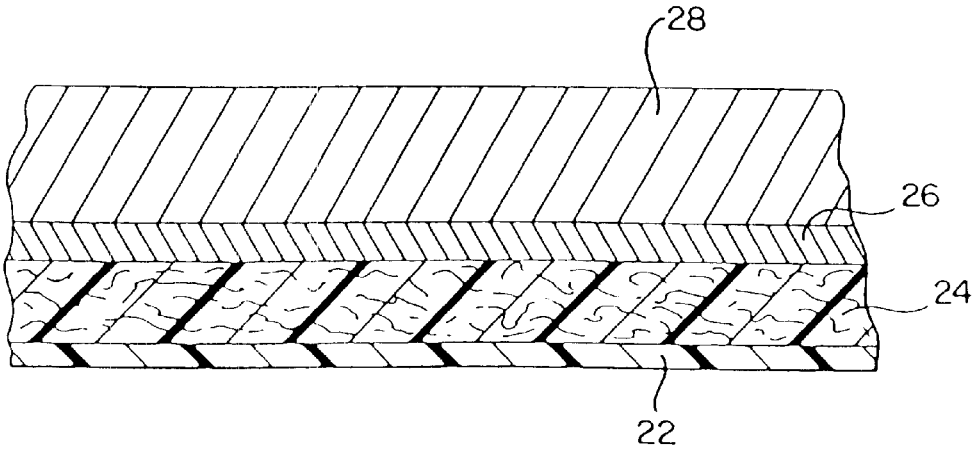
FIG. 2 is a partial cross-sectional view of a wall of the container apparatus of the present invention showing the material layer construction of the container apparatus.

FIG. 1 shows a cross-sectional view of an embodiment of a container apparatus 20 of the present invention. The container apparatus 20 is shown as a cylinder having a circular cross-section. However, the container 20 can be any shape and cross-section. In an alternative embodiment, the container apparatus has a spherical shape. The container apparatus 20 comprises several layers of material as shown in FIGS. 1 and 2. An inner bladder 22 is provided that is capable of being filled with radioactive waste material. The inner bladder 22 is made from a self-sealing material, such as a self sealing rubber or plastic material. The inner bladder 22 is coated with a protective coating 24, such as a fiberglass filled polymer material. The protective coating 24 provides protection to the inner bladder 22 from punctures and other damage that may result in leakage of the radioactive material.

A radiation barrier layer 26 is disposed over the protective coating 24 and prevents radiation from passing therethrough. Preferably, the radiation barrier layer 26 is made from a material containing lead. However, any material having a high optical density to the radiation levels emitted by the radioactive material can be utilized. An impact resistant outer layer 28 is disposed over the radiation barrier layer 26 to complete the container 20. Preferably, the outer layer 28 is made of a rubber-like material having a high elasticity. The outer layer 28 provides further protection to the container 20 during transit and handling.

Before the container 20 is filled, the radioactive waste is processed to form a slurry. Solid waste is processed and mixed with liquid waste to form the slurry. Alternatively, the container can be filled with radioactive waste in a liquid or paste form. The inner bladder 22 is filled with the slurry prior to the application of the other material layers 24, 26, and 28. When in slurry form, the radioactive waste is injected into the inner bladder 22 with a tubular injection device (not shown) that penetrates the inner bladder 22. The injection device fills the inner bladder 22 with the slurry and also draws air out of the inner bladder 22. After the inner bladder 22 is full, the injection device is removed from the inner bladder 22. When the injection device is removed, the self-sealing material of the inner bladder 22 substantially closes the pierced portion of the inner bladder 22.

After the inner bladder 22 is filled, it is then coated with the protective coating 24. The radiation barrier layer 26 is then disposed on the protective coating layer 24. Finally, the impact resistant outer layer 28 is disposed over the radiation barrier layer 26 to complete the container 20.

The container apparatus 20 of the present invention provides a durable container apparatus for storing and transporting nuclear waste. The construction of the container 20 eliminates the use of concrete and is also capable of being filled in a substantially sealed state by utilizing the self-sealing inner bladder 22.

The container 20 is suitable for transportation with a plurality of other similar containers within a storage bay provided in a transportation vehicle. Furthermore, the container 20 can be scaled accordingly so that a plurality of such containers can be stored within a larger storage container, such as a storage pod (not shown). The storage pod can be constructed of a lightweight and durable polymeric material so that it can be easily transported. This type of multiple storage system provides even further protection from the radioactive material during transportation. A storage container 20 having a spherical shape is preferred for this type of storage system.

The multiple storage system just described can also be utilized in transporting nuclear waste or other hazardous material to disposal sites. The container of the present invention anticipates that disposal may be facilitated in outer space. One or more storage pods containing a plurality of containers can be loaded into a cargo hold of a spacecraft, such as a space shuttle. One or more storage pods may also be carried by a carrier that is towed by such a spacecraft. When scaled accordingly, the material construction of container 20 is lighter in weight than a concrete storage container and thus makes the container 20 highly suitable for such transportation.

While the specific embodiments have been illustrated and described, numerous modifications come to mind without significantly departing from the spirit of the invention and the scope of protection is only limited by the scope of the accompanying Claims.

What is claimed is:

1. An apparatus for storing radioactive waste comprising:

a self-sealing bladder;

a protective layer disposed on the bladder;

a radiation barrier disposed on the protective layer; and an impact resistant layer disposed on the radiation barrier;

wherein the self-sealing bladder is penetrated by an injector device and filled with the radioactive waste prior to the disposition of the protective layer, the radiation barrier and the impact resistant layer.

2. The apparatus of claim 1, wherein the self-sealing bladder is made of a self-sealing polymeric material.

3. The apparatus of claim 1, wherein the self-sealing bladder is made of a self-sealing rubber material.

4. The apparatus of claim 1, wherein the radiation barrier is made of a lead-containing material.

5. The apparatus of claim 1, wherein the impact resistant layer is made of a high impact polymeric material.

6. The apparatus of claim 1, wherein the impact resistant layer is made of a rubber material.

7. The apparatus of claim 1, wherein the radioactive waste is in a slurry form.

8. The apparatus of claim 1, wherein the radioactive waste is in liquid form.

9. The apparatus of claim 1, wherein the radioactive waste is in a paste-like form.

10. The apparatus of claim 1, wherein the apparatus has a cylindrical shape.

11. The apparatus of claim 1, wherein the apparatus has a spherical shape.

12. A method for storing radioactive waste in a container comprising the steps of: penetrating a self-sealing bladder and filling the self-sealing bladder with a radioactive material; coating the self-sealing bladder with a protective coating; coating the protective coating with a radioactive barrier coating; and coating the radioactive barrier coating with an impact resistant coating.

* * * * *